United States Patent [19]

Limpach et al.

[11] 3,966,457

[45] June 29, 1976

[54] METHOD OF OPERATING A BLAST FURNACE USING COAL AUXILIARY COMBUSTIBLE

[75] Inventors: Raymond Limpach, Huncherange; Lucien Lorang, Differdange, both of Luxemburg

[73] Assignee: ARBED-Aciéries Réunies de Burbach-Eich-Dudelange S.A. Luxembourg, Luxembourg

[22] Filed: Dec. 5, 1975

[21] Appl. No.: 638,159

[30] Foreign Application Priority Data

Dec. 6, 1974 Luxemburg ..... 434

[52] U.S. Cl. ..... 75/42

[51] Int. Cl.[2] ..... C21B 5/00

[58] Field of Search ..... 75/41, 42

[56] References Cited

UNITED STATES PATENTS

| | | | |
|---|---|---|---|
| 3,301,544 | 1/1967 | Eft | 75/42 X |
| 3,318,686 | 5/1967 | Schulte | 75/42 |
| 3,720,351 | 3/1973 | Coulter et al. | 75/42 |

*Primary Examiner*—M. J. Andrews
*Attorney, Agent, or Firm*—Karl F. Ross; Herbert Dubno

[57] ABSTRACT

Coal of a granulometry of 0.1 to 20 mm is injected into the blast-pipe manifold surrounding an iron-smelting blast furnace. The temperature of between 900°C and 1300°C in this manifold thermally disintegrates the coal by vaporizing volatile components such as water in the coal and reduces the coal to a mesh size of at most 1 mm. The fine particles of coal so produced are blown into the blast furnace through the tuyeres.

10 Claims, 1 Drawing Figure

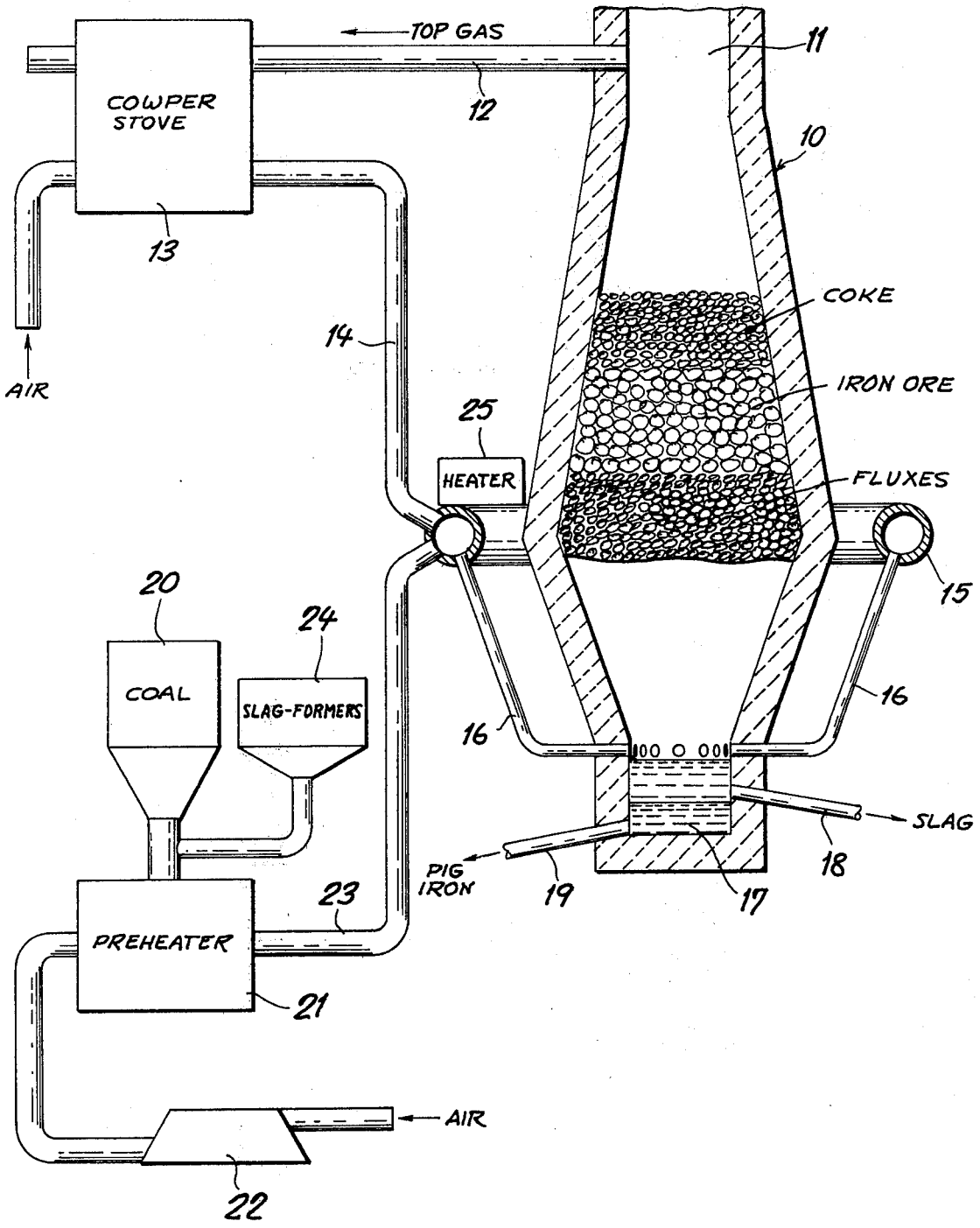
TOP GAS
COWPER STOVE
12
11
10
13
COKE
14
AIR
IRON ORE
25
HEATER
FLUXES
15
20
24
COAL
SLAG-FORMERS
16
16
SLAG
PIG IRON
19
17
18
23
PREHEATER
21
AIR
22

METHOD OF OPERATING A BLAST FURNACE USING COAL AUXILIARY COMBUSTIBLE

FIELD OF THE INVENTION

The present invention relates to the smelting of iron ore. More particularly this invention concerns a method of operating a blast furnace.

BACKGROUND OF THE INVENTION

In the smelting of iron ore in a blast furnace alternate charges of coke and ore fluxes are loaded into the top of blast-furnace blast-furnance shaft. Hot air is blown into the base of the bosh of the furnace and passes upwardly through the layered charges, causing part of the coke to burn and form carbon monoxide so as to heat the coke and drive the carbon dioxide out of the limestone fluxes. The upwardly passing hot gas, above 1000°C, dries the ore in the shaft of the furnace and passes out as top gas. A body of molten iron forms in the bottom of the furnace and a layer of slag on top of it, both of the iron and the slag being tapped off at intervals.

It is known to replace part of the metallurgical coke by so-called auxiliary combustibles which are introduced into the furnace by means of air jets at the level of the tuyeres. This use of auxiliary combustibles reduces the need for increasingly expensive and hard-to get metallurgical cokes, the auxiliary combustibles usually being substantially cheaper. Furthermore the auxiliary combustibles frequently make the smelting operation easier to control. As a rule such auxiliary combustibles are liquid or gaseous hydrocarbons—fuel oil or natural gas—as well as town gas.

It is also known to inject coal in a finely divided powder form directly into a blast furnace. Such a method allows relatively cheap coal to be used directly in the smelting operation, but has been found disadvantageous in that the coal must be dried carefully and then ground to a very fine powdery state. This processing of the coal adds considerably to its cost and, therefore, makes such a method as expensive as one using the more expensive coke directly.

OBJECTS OF THE INVENTION

It is therefore an object of the present invention to provide an improved smelting method.

Another object of this invention is the provision of a method of operating a blast furnace wherein consumption of coke per ton of iron smelted is reduced.

Another object of the present invention is to provide a method of employing solid carbonaceous material, such as coal or lignite, in its raw state in a smelting operation.

SUMMARY OF THE INVENTION

These objects are attained according to the present invention in a method of operating a blast furnace wherein a carbonaceous and combustible coarse granulate containing a vaporizable component is introduced into a chamber separate from the blast furnace and heated in this chamber to a temperature sufficiently high to vaporize this component and explode the granulate into fine particles which are then conducted into the blast furnace. In this manner the complicated and expensive task of finely milling or grinding the coal or other carbonaceous material is eliminated and replaced by a relatively simple heating step that produces very hot and very finely divided particles that readily burn in the blast furnace, taking the place of valuable coke in the smelting operation.

According to further features of this invention the granulate is heated to a temperature above 800°C, and between 900°C and 1300°C. The volatile or vaporizable components that are responsible for the thermal disintegration of the combustible granuals are usually water and volatile compounds which are contained in the combustible, normally coal, or which naturally and normally occur in the combustible. The coal can be injected in the form of a slurry, with 80% at least of the granuals having a mesh size of between 0.1 mm and 20 mm. The water used to transport the coal in such a slurry therefore itself constitutes the vaporizable component that aids in the explosive thermal reduction of the coal granuals into fine particles. Thus it is possible in accordance with the present invention to use types of carbon which are normally considered to be uncokefiable or very difficult to cokefy. Relatively cheap materials may be used with virtually no preprocessing.

The location or chamber where the granulate is thermally reduced to fine particles in accordance with this invention is separate from the furnace and connected to the furnace via appropriate conduits to introduce the fine particles into this furnace. It is also possible in accordance with this invention to use the manifold or blast pipe encircling the bosh of the furnace and connected to the radially extending tuyeres. Thus in accordance with this invention the coal granulate is introduced, for example, by an auger or by blowing, into this blast-pipe manifold and the fine particles formed therein are carried by the hot gas flowing through the tuyeres into the lower part of the bosh. The particles are oxidized immediately as they leave the tuyeres in the blast furnace so that only the combustion products, that is the carbon monoxide, gaseous hydrogen, and nitrogen, come into contact with the descending charge in the blast furnace.

In accordance with further features of this invention the combustible solid and/or the gas serving to transport it are preheated. Cowper stoves or the like can be used for this preheating so as to employ the latent heat in the top gas issuing from the throat of the blast furnace. The temperature of the combustible before its introduction into the thermal disintegration chamber nonetheless is kept below that temperature necessary to vaporize the volatile component of the combustible. In accordance with another feature of this invention the thermal shock is accelerated by raising the temperature at the place where the carbon is introduced into the process to a level well above that of the hot air by introduction of oxygen and/or a liquid or gaseous fluid combustible, or even by using another heat source such as a laser beam or plasma torch.

The transport gas for injecting the combustible granulate can be a combustive oxygen-gas, for example air or waste gases containing carbon dioxide, or a combustible gas with a hydrocarbon base, carbon monoxide, hydrogen, or a mixture of these three.

According to yet another feature of this invention the ash and sulfur contained in the combustibles used can be bonded by incorporating in the injected flow the necessary quantity of chalk or any other means serving to bond the sulfur and form with the ashes a slag-type material.

BRIEF DESCRIPTION OF THE DRAWING

The above and other objects, features, and advantages will become more readily apparent from the following, reference being made to the accompanying drawing whose sole FIGURE is a diagrammatic representation of an installation according to the present invention.

SPECIFIC DESCRIPTION

The arrangement according to the present invention has a blast furnace 10 into whose throat 11 coke, iron ore, and fluxes are loaded to form a layered charge within the shaft of the furnace. A top gas issuing from above the throat of the furnace through a conduit 12 is fed to a Cowper stove 13 where its latent heat is employed to heat air that is fed iva a conduit 14 to a blast-pipe manifold 15 surrounding the belly of the furnace 10. Extending downwardly from this blast-pipe manifold 15 are a plurality of tuyeres 16 terminating in the lower portion of the bosh in the furnace 10 above the charge 17 of molten iron therein. Slag is drawn off through an outlet 18 above another outlet 19 whence pig iron is drawn off.

Coal from a hopper 20 and slag farmers from a hopper 24 are fed into a preheater 21 in which air is blown via a turbine 22. The preheated coal and slag farmers are blown in a current of hot air through a conduit 23 to the hot-blast pipe 15 where it is subject to thermal disintegration as described above and then blown into the furnace 10 through the tuyeres 16. A heater 25 on the manifold augments the heating of the coal therein.

SPECIFIC EXAMPLE

Iron was smelted in a blast furnace equipped with a pressure-control throat and having the following characteristics:

Diameter at bosh = 9.0 m;
Useful volume = 1786 $m^2$;
Principal air tuyeres = 20;
Auxiliary air tuyeres = 14; and
Normal production capacity: 100–105 t/h of Thomas pig iron from agglomerated minette ore.

The following operating conditions were employed:

Fusion bed = 100% self-melting agglomerate at 41.3% iron;
Temperature of hot air = 1200°C;
Oxygen enrichment of air with 99.60% pur oxygen = 50 $m^3$ STP/t pig iron (equal to dry air enriched to 24.2% oxygen);
Injection of coal:
type = rich combustible coal,
quantity = 150 kg/t pig iron,
analysis =
$H_2O$ = 5%,
Ash = 6%
Volatile component = 33% when dry,
Mesh size = 0–20 mm;

Temperature of the flame at the outlet of the tuyeres above 2050°C. The injection of 150 kg of coal as described above per ton of pig iron gives a flame temperature of 2150°C if the hot air is heated to 1200°C and if it is enriched with oxygen to 24.2%.

Method of injection:

The introduction of coal, in order to thermally disintegrate it in a hot chamber before transferring it to the combustion or fusion zone of the furnace, can be carried out at different places in the hot-air circuit.

Thus a disintegration chamber can be mounted in a conduit parallel to the conduit carrying the hot air from the Cowper stove to its manifold. This method ensures even distribution of the thermally disintegrated coal to all of the principal tuyeres.

Since it is preferable to have individually controllable feed for each tuyere the carbon is advantageously introduced into the manifold for the tuyeres.

On contact with the hot air the volatile materials in the coal expand suddenly and disintegrate thermally to particles having a mesh size of at most 1 mm.

Results of the process:

Consumption of coke at 85% carbone and 3% water = 430.3 kg/t pig iron;
Consumption of coal as described above = 150.0 kg/t pig iron;
Replacement ratio of coke by coal = 0.83, that is that the normal consumption of coke for the furnace was normally 554.8 kg/t of pig iron;
Quantity of slag produced = 949 kg/t pig iron;
Index of basicity of the slag = $CaO/SiO_2$ : 1.38, and $CaO+MgO/SiO_2 + Al_2O_3$:1.039;
Feed of dry air without oxygen enrichment = 1174 $m^3$ STP/t pig iron; and
Temperature of flame in front of tuyeres = 2150°C.

Hourly rates:

Pig iron = 100 t/h
Slag = 95.9 t/h,
Coke = 43.03 t/h,
Coal = 15.0 t/h,
Humidified air at 7.5 grams $H_2O/m^3STP$ = 118,400 $m^3STP/h$,
Oxygen for enriching air = $5000^2$ $m^3/h$,
Dry top gas = 180,500 $m^3STP/h$,
Feed pressure for air to blast-pipe manifold = 3 bars, and
Pressure at throat = 2 bars.

We claim:

1. In a method of operating a blast furnace wherein, hot gas rises countercurrent to a descending column of coke and iron ore to smelt the ore and burn the coke, the improvement comprising the steps of sequentially:

introducing a carbonaceous combustible granulate containing a vaporizable component into a chamber separate from said blast furnace,
rapidly heating said granulate in said chamber to a temperature sufficiently high to vaporize said component and explode said granulate into fine particles, and
conducting said particles from said chamber into said furnace.

2. The improvement defined in claim 1 wherein said granulate is coal and said temperature is at least 800°C.

3. The improvement defined in claim 1 wherein said granulate is coal and at least 80% by weight of the granules have a mesh size between 0.1 mm and 20 mm.

4. The improvement defined in claim 1 wherein said chamber is connected to the tuyeres of said blast furnace and said particles are blown into said blast furnace through said tuyeres.

5. The improvement defined in claim 1, further comprising the step of heating said granulate prior to introduction thereof into said chamber to a temperature insufficient to vaporize said component.

6. The improvement defined in claim 1 wherein said granulate is introduced into said chamber by being blown in with a gas.

7. The improvement defined in claim 6, further comprising the step of heating said gas to preheat said granulate to a temperature insufficient to vaporize said component.

8. The improvement defined in claim 1, further comprising the step of adding auxiliary heat to the location at which the granulate is introduced in order to intensify the thermal shock that explodes said granulate.

9. The improvement defined in claim 1, further comprising the step of mixing with said granulate prior to introduction of sand into said slag-formers.

10. The improvement defined in claim 1 wherein said granulate is coal, said temperature being between 900°C and 1300°C.

* * * * *